US007007797B1

(12) United States Patent
Ruccolo

(10) Patent No.: US 7,007,797 B1
(45) Date of Patent: Mar. 7, 2006

(54) PAINT BRUSH PROTECTIVE CADDY

(76) Inventor: Anthony Ruccolo, 285 Lynn Shore Dr., Lynn, MA (US) 01902

( * ) Notice: Subject to any disclaimer, the term of this patent is extended or adjusted under 35 U.S.C. 154(b) by 27 days.

(21) Appl. No.: 10/388,082

(22) Filed: Mar. 13, 2003

(51) Int. Cl.
*B65D 75/14* (2006.01)

(52) U.S. Cl. ..... 206/263.4; 206/15.2; 206/15.3

(58) Field of Classification Search ..... 206/362.2, 206/362.3, 15.2, 15.3, 362.4, 372, 361; 220/837, 220/838, 839, 840; 211/65; 248/110; 15/184, 15/185
See application file for complete search history.

(56) References Cited

U.S. PATENT DOCUMENTS

| | | | | | |
|---|---|---|---|---|---|
| 224,913 | A | | 2/1880 | Hollwede | |
| 1,266,382 | A | * | 5/1918 | Bailey | 206/362.3 |
| 1,852,679 | A | * | 4/1932 | Schneider | 206/362.4 |
| 2,004,320 | A | | 6/1935 | Hanson | |
| 2,216,543 | A | * | 10/1940 | Schumann | 206/362.4 |
| 3,800,998 | A | | 4/1974 | Gask | |
| 3,981,399 | A | | 9/1976 | Crouch | |
| 4,606,456 | A | * | 8/1986 | Kaminski | 206/362.4 |
| 4,847,939 | A | | 7/1989 | Derencsenyi et al. | |
| 5,191,973 | A | * | 3/1993 | Shteynberg | 206/15.2 |
| 5,244,090 | A | | 9/1993 | Keith | |
| 5,363,959 | A | * | 11/1994 | Crosby et al. | 206/362.4 |
| 5,465,453 | A | | 11/1995 | Landmeier | |
| 6,199,694 | B1 | | 3/2001 | Van Diest et al. | |
| 6,338,406 | B1 | | 1/2002 | Zagar | |
| D457,732 | S | * | 5/2002 | Ray | D4/199 |
| 6,390,430 | B1 | * | 5/2002 | Hawley et al. | 248/311.2 |
| 6,450,336 | B1 | | 9/2002 | Edes | |
| 6,675,966 | B1 | * | 1/2004 | Ray | 206/362.4 |
| 6,757,931 | B1 | * | 7/2004 | Nordstrom | 15/248.1 |

* cited by examiner

*Primary Examiner*—Shian T. Luong
(74) *Attorney, Agent, or Firm*—Altman & Martin

(57) ABSTRACT

The paint brush protective caddy of the present invention is an open-top compartment bounded by a back, two sides, a bottom, and a front flap. The front flap is openable for inserting a brush in the compartment. To be openable, the front flap is attached to the bottom by a hinge. Alternatively, the bottom and front flap form a relatively rigid 90° corner and the caddy is composed of a material that will bend as a result of application of a moderate amount of force. The brush bristles fit into the compartment and is secured by a flexible strap that extends over the brush from the back. At least one surface includes a multitude of through holes to provide air circulation for allowing the brush to dry.

9 Claims, 4 Drawing Sheets

PAINT BRUSH PROTECTIVE CADDY

CROSS-REFERENCES TO RELATED APPLICATIONS

Not Applicable

STATEMENT REGARDING FEDERALLY SPONSORED RESEARCH OR DEVELOPMENT

Not Applicable

REFERENCE TO A SEQUENCE LISTING, A TABLE, OR A COMPUTER PROGRAM LISTING COMPACT DISK APPENDIX

Not Applicable

BACKGROUND OF THE INVENTION

1. Field of the Invention

The present invention relates to painting equipment, more particularly, to caddies for protecting paint brushes between uses.

2. Description of the Related Art

The most common device for applying paint is a paint brush. The cost of a paint brush can vary depending on the material from which the bristles are made. Many professional painters today use high quality paint brushes with substantial costs. Thus, in order to prolong brush life and reduce equipment costs, painters take care of their expensive paint brushes. After a paint brush has been used, a painter cleans the brush in an appropriate solution to remove all of the existing paint. Sometimes, after cleaning, the bristles randomly separate. Also, when not in use, the brush may be placed in a tool box or chest, on a work bench, or in another area where tools, sides of the box, and other items can bend, distort, or otherwise damage the bristles. This distortion of the bristles becomes an issue when the painter needs to use the brush again and the edges of the brush are not uniformly aligned. When the bristles are bent or distorted, it is difficult to achieve the desired finish and a new brush is needed.

There are a quite a number of brush covers disclosed in the prior art. Examples include U.S. Pat. Nos. 224,913; 2,004,320; 3,981,399; 4,847,939; 5,244,090; 6,199,694; 6,338,406; and 6,450,336. While the devices disclosed in these patents may accomplish their stated objectives to varying degrees, they each have their shortcomings. Those covers made of paper products are not reusable, since they soak up the brush cleaner and become weakened and distorted. Some are made of metal, requiring hinges and/or multiple components that increase the manufacturing cost. Others are meant to hang with the bristles pointing upwardly, causing the cleaning fluid to flow into the ferrule portion of the brush. Still others are intended to keep the brush moist, rather than to let it dry. Consequently, there is a need for a device that maintains the brush bristles in their proper shape and orientation, while permitting the bristles to dry. There is also a need for such a devise that is economical to manufacture and easy to use, in the sense of permitting easy and rapid insertion and removal of the brush.

BRIEF SUMMARY OF THE INVENTION

An object of the present invention is to provide a paint brush protective caddy that maintains the shape of the bristles while permitting the brush to dry.

A further object is to provide a paint brush caddy into which the paint brush can be inserted, removed, and secured easily.

A further object is to provide a paint brush caddy that is relatively inexpensive to manufacture.

The paint brush protective caddy of the present invention is a compartment with an open top and bound by a back, two sides, a bottom, and a front flap. The brush bristles fit into the compartment and is secured by a flexible strap that extends over the brush from the back.

The caddy is formed from a single sheet of material. In one configuration, the sides are attached to the back by a fixed 90° corners. Alternatively, the sides are attached to the back by hinges, which can minimize storage space because the caddy can be laid flat. The bottom is similarly attached to the back, either by a fixed 90° corner or by a hinge. The preferred hinge is a living hinge, formed by providing a shaped groove in the surface of the sheet.

The flap can be pulled from the sides so that the brush can be easily inserted. In one embodiment, the front flap is attached to the bottom by a hinge. In another embodiment, the bottom and front flap form a relatively rigid 90° corner, and the caddy is composed of a material that will bend as a result of application of a moderate amount of force. Applying a pulling force causes the bottom to bend and removing the force allows the flap to return to the closed position. Optionally, the side edges of the flap are provided by a means for retaining the sides in the closed position when the flap is closed.

The strap retains the brush in the compartment. The strap may extend diagonally or vertically from the top edge. The strap is stretched over the brush shoulder and a removable fastener attaches it to the front flap. The removable fastener can take any appropriate form, the preferred form being a microcatch (microhook/microloop) fastener.

At least one surface includes a multitude of through holes to provide air circulation for allowing the brush to dry. Also, since one purpose of the caddy is to prevent the brush bristles from separating during drying, the caddy should fit the brush bristles relatively snuggly. For angled brushes, the bottom will be angled so that gravity will not cause the longer bristles to compact or curl toward the shorter bristles.

The caddy material is impervious to the liquids with which the brush will be employed. The preferred materials are plastics, such as copolypropylene and high-density polyethylene. The thickness of the material will be determined by the material itself. The strap will most likely be thinner than the remainder of the sheet in order to obtain the necessary flexibility.

Other objects of the present invention will become apparent in light of the following drawings and detailed description of the invention.

BRIEF DESCRIPTION OF THE DRAWINGS

For a fuller understanding of the nature and object of the present invention, reference is made to the accompanying drawings, wherein.

DETAILED DESCRIPTION OF THE INVENTION

Figure 1:
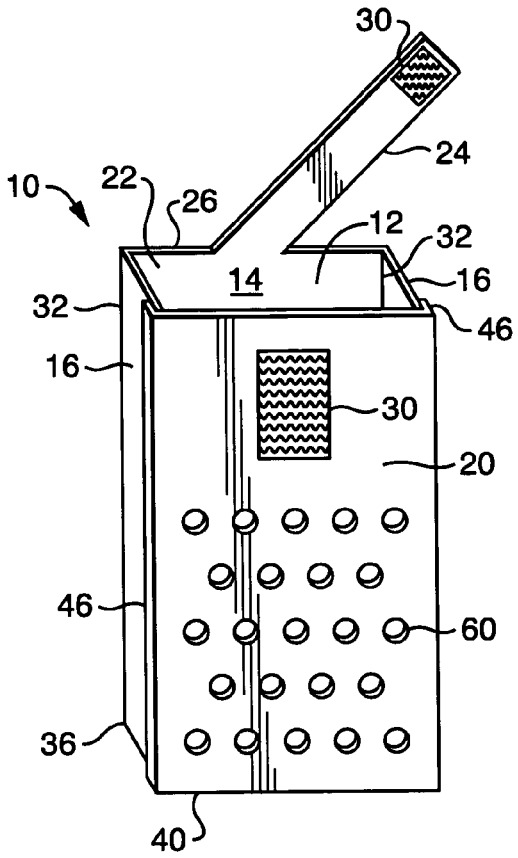
FIG. 1 is a perspective view of one configuration of the paint brush protective caddy of the present invention when open.
Figure 2:
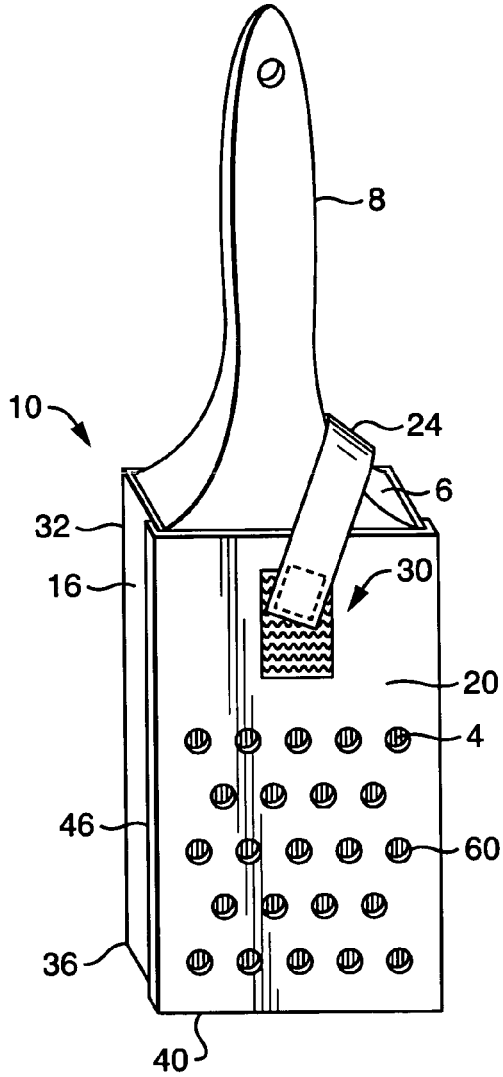
FIG. 2 is a perspective view of the paint brush protective caddy of FIG. 1 with a brush installed.

The paint brush protective caddy 10 of the present invention has a back 14, two sides 16, a bottom 18, a front flap 20, bounding a compartment 12 with an open top 22. All of the surfaces are relatively flat. A strap 24 extends from the free top edge 26 of the back 14.

Figure 3:
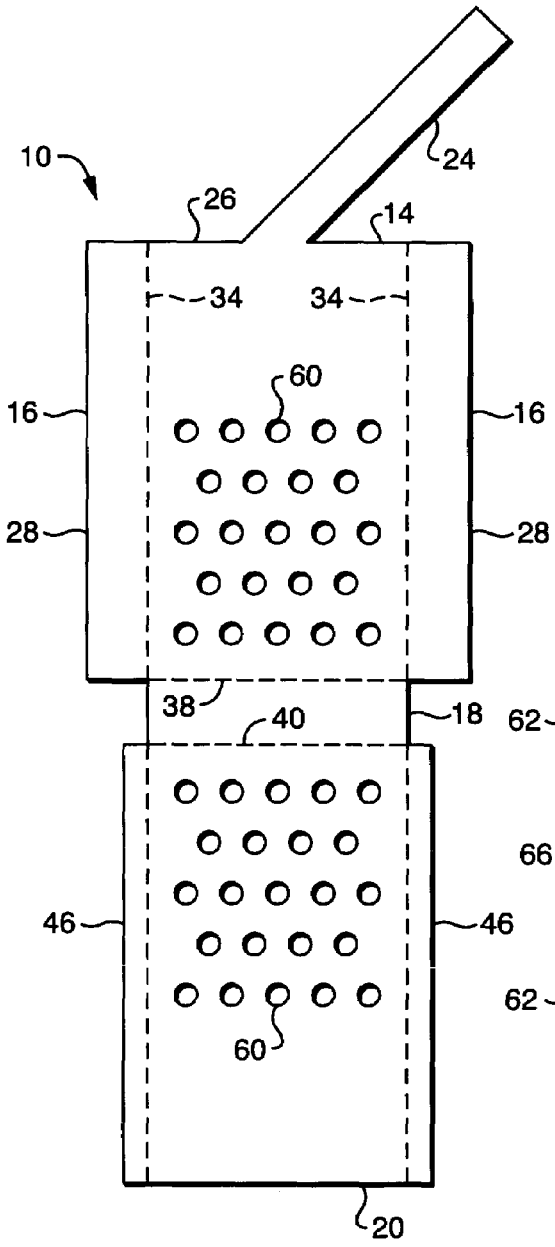
FIG. 3 is an elevational view of the template from which a configuration of the paint brush protective caddy of FIG. 1 is formed.

Preferably, the caddy 10 is formed from a single sheet of material, as in FIG. 3. In one configuration, each side 16 is attached to the back 14 by a fixed 90° corner 32, where the sides 16 are opposed and parallel to each other, as in FIG. 1. Alternatively, each side 16 is attached to the back 14 by a hinge 34 so that the sides 16 can be opened, that is, positioned coplanar with the back 14, and closed, that is, folded to be perpendicular to the back 14, when the caddy 10 is in use. This configuration minimizes storage space because the caddy 10 can be laid flat. The bottom 18 is attached to the back 14 in a manner similar to the sides 16, either by a fixed 90° corner 36 or by a hinge 38.

In one embodiment, the attachment 40 of the front flap 20 to the bottom 18 is by a hinge so that the flap 20 can be opened to provide easy access to the compartment 12. In another embodiment, the attachment 40 is by a relatively rigid 90° corner. The caddy 10 is composed of a material that will bend as a result of application of a moderate amount of force. The normal position of the flap 20 is to enclose the compartment 12. Applying a pulling force to the flap 20 will cause the bottom 18 to bend so that the flap 20 pivots away from the sides 16. Removing the force allows the flap 20 to return to the position enclosing the compartment 12.

Optionally, particularly with the side-hinged configuration, the side edges of the flap 20 are angled at 90° to provide lips 46 that retain the sides 16 in the closed position. In another configuration, not shown, the flap 20 includes a pair of grooves into which the sides 16 fit when the flap 20 is closed. In yet another configuration, shown in FIG. 4, the sides 16 each include one or more planar tabs 62 that fit into mating slots 64 in the flap 20.

Figure 6:
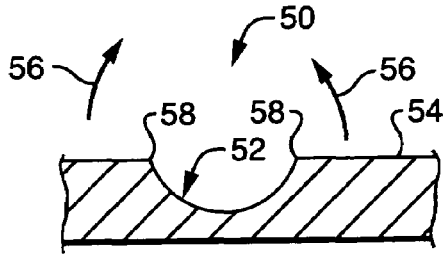
FIG. 6 is a cross-section view of the living hinge of the bottom of one configuration of the paint brush protective caddy.

For those configurations that use a hinge, preferably the hinge is a living hinge, a cross-section of which is shown in FIG. 6. The hinge 50 is formed by providing a shaped groove 52 in the surface of the sheet 54. Typically, the groove 52 will be on the side of the sheet 54 toward which the bending motion will occur, as at 56. The depth of the groove 52 is such that the material can be bent as easily as necessary while retaining the integrity and resiliency of the material. Typically, thickness of sheet 54 at the center of the groove 52 will be about ½ to ⅓ the thickness of the sheet 54 adjacent to the groove 52. The groove 52 has a width such that, when the sheet 54 is bent to its fullest intended extent (90° in the present invention), the groove edges 58 do not touch or otherwise interfere with each other. Typically, the groove 52 will have a rounded shape, as in FIG. 4.

Extending from the top edge 26 of the back 14 is a strap 24, the purpose of which is to retain a brush 8 in the compartment 12. The strap 24 may extend diagonally from the top edge 26, as in FIG. 1. Alternatively, the strap 24 may extend perpendicularly from the top edge 26 and offset from the center so as to have interference from the brush handle 4, as in FIG. 4.

After the brush 8 is installed, the strap 24 is stretched over the brush shoulder 6 and removably attached by its end to the front flap 20. The removable fastener 30 can take any appropriate form. One preferred removable fastener is a microcatch (microhook/microloop) fastener. The advantage of the microcatch fastener is that it is easily adjustable for brushes of differing shoulder shapes. Another example of a removable fastener is a snap. The strap 24 must be flexible enough so that it will not overpower the fastener 30 and cause the fastener 30 to disconnect.

Figure 4:
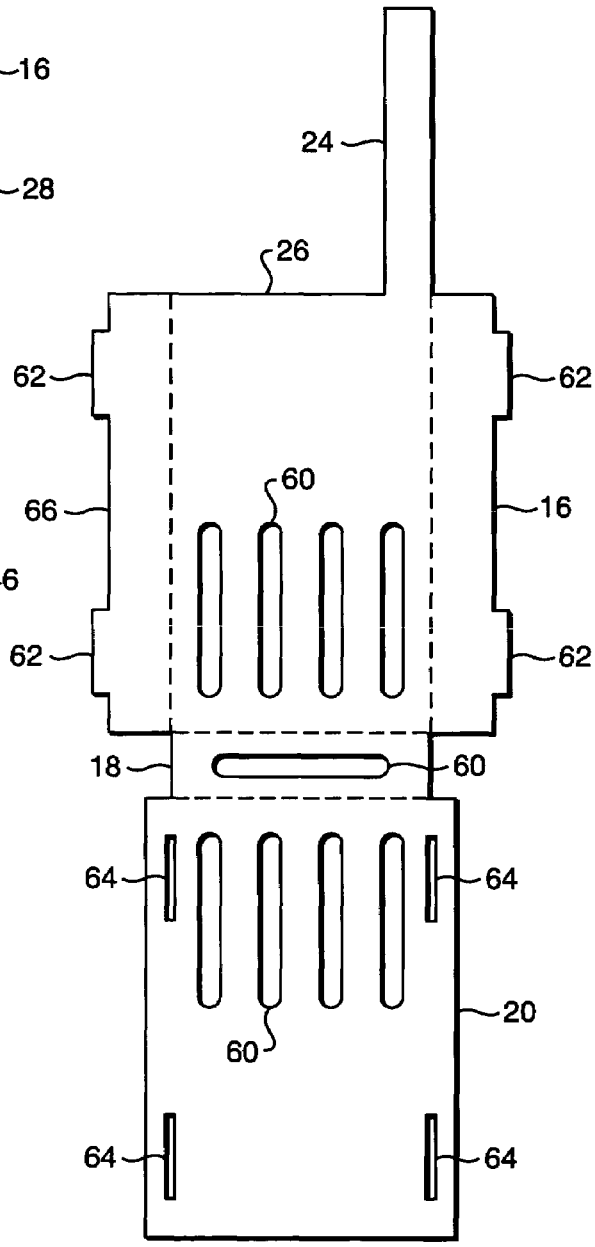
FIG. 4 is a perspective view of the paint brush protective caddy showing alternative configurations of various independent features.
Figure 5:
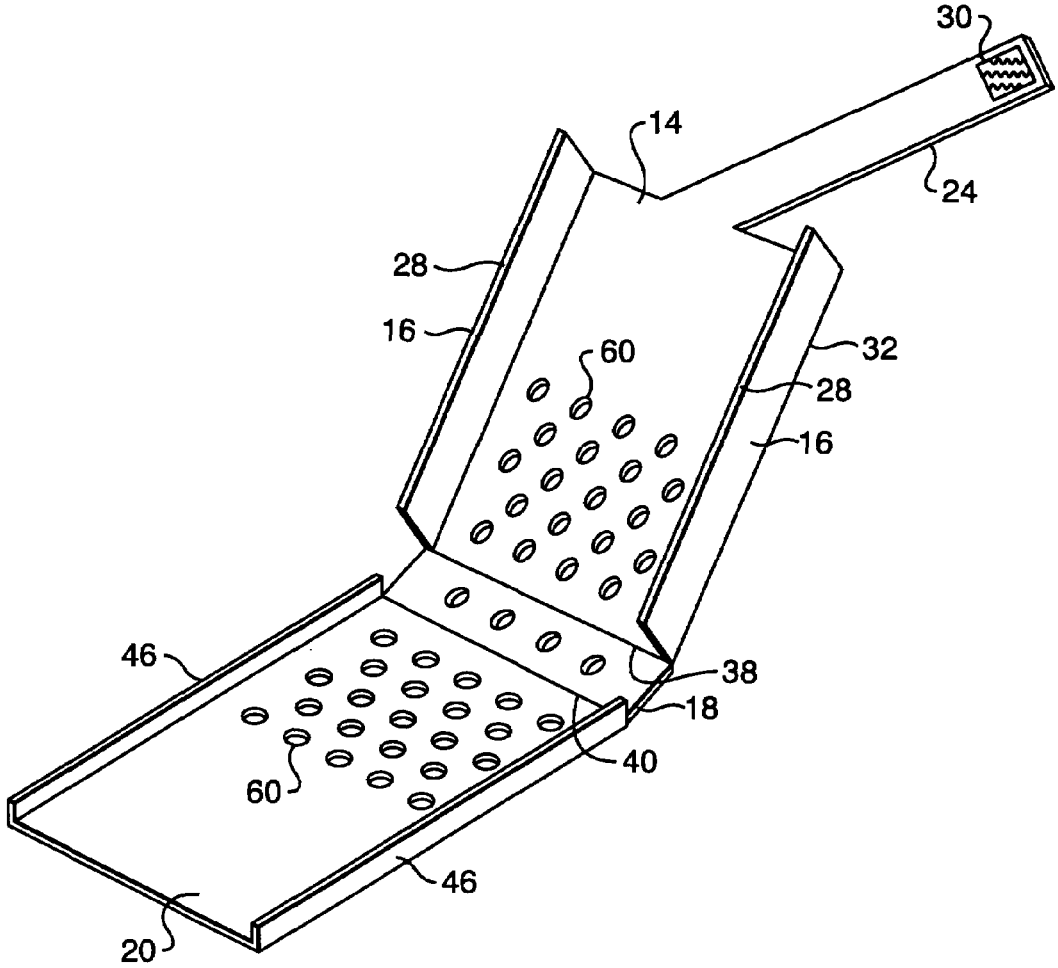
FIG. 5 is a perspective view of the paint brush protective caddy of FIG. 1 in an open state.

At least one surface, the back 14 or front flap 20, includes a multitude of through holes 60 to provide air circulation for allowing the brush 8 to dry. There may also be holes 60 in the sides 16 and bottom 18. There are no specific parameters, such as shape, size, or quantity, contemplated for the holes 60, only that the holes 60 be such that there is enough air circulation to allow the brush 8 to dry within a reasonable amount of time. The actual size and shape of the holes 60 may be function of the manufacturing process. Round holes are shown in FIG. 1 and elongated holes are shown in FIG. 4. The present invention contemplates that a single caddy 10 may have holes 60 of various sizes and shapes.

The material from which the caddy 10 is constructed must be impervious to the liquids with which the brush will be employed. Such liquids include, but are not limited to, water, latex paint, oil-based paint, brush cleaning solvents, and paint thinners. The preferred materials are plastics, such as copolypropylene and high-density polyethylene. Copolypropylene is preferred for most applications. High-density polyethylene may be used in the protective caddy 10 for smaller brushes.

The material from which the caddy 10 is composed will determine the thickness of the material. For the preferred materials, the thickness of the main surfaces will be in the range of about 1/16 inch to 3/32 inch (62.5 mils to 94 mils). The strap 24, however, will be thinner in order to obtain the necessary flexibility, and will be in the range of 1/32 inch to 1/16 inch (31 mils to 62.5 mils).

One purpose of the caddy 10 is to prevent the brush bristles 4 from separating during drying. Consequently, the caddy 10 should fit the brush bristles 4 relatively snuggly, and the inside dimensions of the caddy 10 should reflect this. The length is not important for square-bottom brushes, since drying does not cause problems with the length of the bristles 4. The present invention contemplates that there will be a series of sizes that will cover the common brush sizes that vary in width and thickness.

Figure 7:
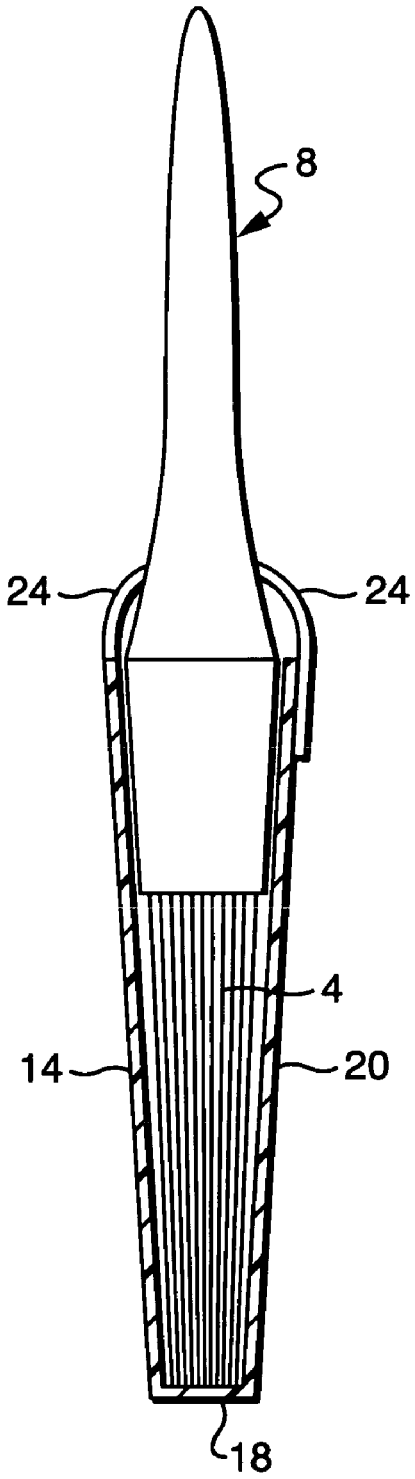
FIG. 7 is a cross-sectional, side view of a caddy for an angled brush.

The present invention contemplates that the caddy will be used for brushes with angled or other-shaped bristles 4. For angled brushes, the bottom 18 will be angled so that gravity will not cause the longer bristles to compact or curl toward the shorter bristles. In addition, angled brushes are generally made with a taper in thickness from the ferrule to the bristle ends. Consequently, the present invention contemplates that the thickness of the caddy 10 for angled brushes will decrease toward the end of the bristles 4, as in FIG. 7.

Thus it has been shown and described a paint brush protective caddy which satisfies the objects set forth above.

Since certain changes may be made in the present disclosure without departing from the scope of the present invention, it is intended that all matter described in the foregoing specification and shown in the accompanying drawings be interpreted as illustrative and not in a limiting sense.

I claim:

1. A paint brush protective caddy for use with a paint brush having bristles and a handle with a shoulder therebetween, said caddy comprising:

(a) a compartment having an open top and bounded by (i) a back having a free top edge, a pair of opposed side edges, and a bottom edge, (ii) a pair of parallel, opposed sides extending at side corners from said opposed side edges of said back, each side having a free top edge, a free front edge, and a free bottom edge, (iii) a completely flat bottom extending from said back bottom edge to a front edge and fee side edges, said free side edges being approximately parallel to said free bottom edges of said sides, and (iv) a front flap having an attachment to said bottom front edge, said font flap having a free top edge and free side edges approximately parallel to said side free front edges, said front flap adapted to be pulled away from and returned to said sides while remaining attached to said bottom front edge;

(b) a plurality of through holes in at least one of said back and said front flap;

(c) a flexible strap extending from said free edge of said back to a free end and adapted to be curved over said open top of said compartment; and (d) a removable attachment for attaching said strap free end to said front flap;

(e) whereby, said flap is pulled from said front edges of said sides, said brush is placed in said compartment such that said brush handle extends outside of said open top of said compartment, said flap is returned to said front edges of said sides, and said strap is stretched over said brush shoulder and attached to said front flap by said removable attachment.

2. The paint brush protective caddy of claim 1 wherein said removable attachment is a microhook/microloop fastener.

3. The paint brush protective caddy of claim 1 wherein said attachment of said front flap to said bottom front edge is a hinge.

4. The paint brush protective caddy of claim 3 wherein said hinge is a living hinge.

5. The paint brush protective caddy of claim 1 wherein each of said side corners is hinged such that said sides have an open position wherein said sides are approximately coplanar with said back and a closed position wherein said sides are approximately perpendicular to said back, and wherein said flap includes a means for retaining said sides in said closed position.

6. The paint brush protective caddy of claim 1 wherein said caddy is composed of a material that is unaffected by water, paints, paint thinners, paint removers, and brush cleaners.

7. A paint brush protective caddy for use with a paint brush having bristles and a handle with a shoulder therebetween, said caddy comprising:

(a) a compartment having an open top and bounded by (i) a back having a free top edge, a pair of opposed side edges, and a bottom edge, (ii) a pair of parallel, opposed sides extending at side corners from said opposed side edges of said back, each side having a free top edge, a free front edge, and a free bottom edge, (iii) a completely flat bottom extending from said back bottom edge to a front edge and free side edges, said free side edges being approximately parallel to said free bottom edges of said sides, and (iv) a front flap having an attachment to said bottom front edge, said front flap having a free top edge and free side edges approximately parallel to said side free front edges, said font flap adapted to be pulled away from and returned to said sides while remaining attached to said bottom front edge;

(b) a plurality of through holes in at least one of said back and said front flap;

(c) a flexible strap extending from said free edge of said back to a fee end and adapted to be curved over said open top of said compartment; and (d) a microhook/microloop fastener for removably attaching said strap free end to said front flap;

(e) said caddy being composed of a material that is unaffected by water, paints, paint thinners, paint removers, and brush cleaner;

(f) whereby, said flap is pulled from said font edges of said sides, said brush is placed in said compartment such that said brush handle extends outside of said open top of said compartment, said flap is returned to said front edges of said sides, and said strap is stretched over said brush shoulder and attached to said front flap by said removable attachment.

8. The paint brush protective caddy of claim 7 wherein said attachment of said front flap to said bottom front edge is a living hinge.

9. The paint brush protective caddy of claim 7 wherein each of said side corners is hinged such that sides have an open position wherein said sides are approximately coplanar with said back and a closed position wherein said sides are approximately perpendicular to said back and wherein said flap includes a means for retaining said sides in said closed position.

* * * * *